US008852356B2

(12) United States Patent
Spitzer et al.

(10) Patent No.: US 8,852,356 B2
(45) **Date of Patent: *Oct. 7, 2014**

(54) METHOD FOR PRODUCING A HOT ROLLED STRIP AND HOT ROLLED STRIP PRODUCED FROM FERRITIC STEEL

(75) Inventors: Karl-Heinz Spitzer, Clausthal (DE); Bianca Springub, Hannover (DE); Joachim Konrad, Düsseldorf (DE); Hellfried Eichholz, Ilsede (DE); Markus Schäperkötter, Braunschweig (DE)

(73) Assignees: Salzgitter Glachstahl GmbH, Salzgitter (DE); SMS Siemag AG, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/255,539

(22) PCT Filed: Mar. 11, 2009

(86) PCT No.: PCT/DE2009/000328

§ 371 (c)(1),
(2), (4) Date: Nov. 10, 2011

(87) PCT Pub. No.: WO2010/102595

PCT Pub. Date: Sep. 16, 2010

(65) Prior Publication Data

US 2012/0093677 A1 Apr. 19, 2012

(51) Int. Cl.
*C22C 38/38* (2006.01)
*C22C 38/22* (2006.01)

(52) U.S. Cl.
USPC ..... 148/95; 148/522

(58) Field of Classification Search
USPC ..... 148/95, 522
See application file for complete search history.

(56) References Cited

U.S. PATENT DOCUMENTS

| | | | | |
|---|---|---|---|---|
| 6,106,638 | A | 8/2000 | Paradis et al. | |
| 6,240,617 | B1 * | 6/2001 | Nitoh et al. | 29/527.7 |
| 8,047,263 | B2 | 11/2011 | Spitzer et al. | |
| 8,069,904 | B2 | 12/2011 | Spitzer et al. | |
| 2007/0199631 | A1 | 8/2007 | Engl et al. | |
| 2007/0289717 | A1 * | 12/2007 | Kroos et al. | 164/462 |
| 2009/0065104 | A1 * | 3/2009 | Sellger et al. | 148/542 |
| 2009/0196785 | A1 | 8/2009 | Spitzer et al. | |
| 2009/0266503 | A1 | 10/2009 | Spitzer et al. | |

FOREIGN PATENT DOCUMENTS

| | | | | |
|---|---|---|---|---|
| DE | 100 60 948 | C2 | 6/2002 | |
| DE | 10 2004 061 284 | A1 | 7/2005 | |
| DE | 10 2005 052 774 | | 6/2006 | |
| DE | 10 2005 063 058 | B3 | 5/2007 | |
| EP | 1811048 | A1 * | 7/2007 | B01D 53/88 |

OTHER PUBLICATIONS

Karl-Heinz Spitzer et al.: "Direct Strip Casting (DSC)—an Option for the Production of New Steel Grades", in: steel research, vol. 74, No. 11/12, Jan. 1, 2003, pp. 724-731.

* cited by examiner

*Primary Examiner* — Rebecca Lee
(74) *Attorney, Agent, or Firm* — Henry M. Feiereisen LLC

(57) ABSTRACT

The invention relates to a method for producing a hot strip from transformation-free ferritic steel, wherein a melt is cast into a roughed strip and the latter is subsequently rolled into a hot strip. For this purpose, it is provided that the melt is cast in a horizontal strip casting facility under conditions of a calm flow and free of bending into a roughed strip in the range between 6 and 20 mm and is subsequently rolled into hot strip having a degree of deformation of at least 50%.

16 Claims, No Drawings

METHOD FOR PRODUCING A HOT ROLLED STRIP AND HOT ROLLED STRIP PRODUCED FROM FERRITIC STEEL

CROSS-REFERENCES TO RELATED APPLICATIONS

This application is the U.S. National Stage of International Application No. PCT/DE2009/000328, filed Mar. 11, 2009, which designated the United States and has been published as International Publication No. WO 2010/102595.

BACKGROUND OF THE INVENTION

The invention relates to a method for producing a hot strip from a transformation-free ferritic steel, wherein a melt is cast into a roughed product and the latter is then rolled into a hot strip.

Transformation-free ferritic steels cannot be produced by using the common continuous casting route, i.e. continuous casting of the melt into a slab or thin slab which is rolled either in-line or separately into a hot strip, with the required properties.

The reasons for that reside in the fact that the slab or thin slab, produced by continuous casting, has macro segregations and forms shrink marks. Moreover, the roughed product has a very coarse grain and casting with casting powder poses problems because of the high aluminum content of the ferritic steel.

DE 100 60 948 C2 discloses a production of hot strips from steel having a high manganese content with 12 to 30 weight-% of manganese and up to 3.5 weight-% of each of aluminum and silicon in such a way that the steel melt is cast in a double-roller casting machine to form a roughed strip close to the final dimensions with a thickness of up to 6 mm, and subsequently the roughed strip is hot rolled continuously preferably in a single pass.

The stated upper limit for the thickness with 6 mm cannot be achieved with existing facilities. The maximum thickness that can actually be adjusted is typically 4 mm, in exceptional cases maximal 5 mm.

This known method has the advantage that macro segregations are reduced, shrink marks are suppressed, and the problem associated with casting powder is not relevant.

It is, however, disadvantageous that the small starting thickness of the hot strip permits only a small hot deformation degree during rolling, when a thickness of 2-3 mm of the hot strip is desired.

This thickness range, for example, is however of interest for the use of the hot strip as lightweight component in the exhaust tract of motor vehicles on the one hand. On the other hand, a cold strip with a thickness of, for example, 1.0-1.8 mm can be produced from a hot strip of a thickness of 2-3 mm at a degree of deformation of 40-50% and can again be used, for example, in the exhaust tract of motor vehicles. A small hot deformation degree means, however, coarse grain which adversely affects ductility and thus the formability of the hot strip.

SUMMARY OF THE INVENTION

It is therefore an object of the invention to provide a method for producing a hot strip from transformation-free ferritic steel which method is able to realize a fine grain in the hot strip of 2-3 mm thickness while maintaining the benefits of the double-roller casting machine.

This object is attained by a method in which the melt is cast in a horizontal strip casting facility under conditions of a calm flow and free of bending into a roughed strip in the range between 6 and 20 mm, and subsequently rolled into a hot strip with a degree of deformation of at least 50%.

The proposed method has the advantage that the benefits of the known double-roller casting machine, like reduction of macro segregations, suppression of shrink marks, and prevention of the problem associated with casting powder, are retained, even when the ferritic steel has high Al contents, when using a horizontal strip casting facility, and furthermore the thickness of the hot strip is significantly above the thickness of a hot strip produced by means of a double-roller casting machine.

This affords the possibility to attain high degrees of deformation in terms of adjusting a fine grain in the microstructure of the hot strip; this is true in particular when the hot strip has a thickness in the range of 2-3 mm.

In terms of the process, it is proposed to achieve the calmness of flow by using a co-moving electromagnetic brake, which generates a field co-moving in synchronism or with optimal speed in relation to the strip, to ensure that in the ideal case the speed of the melt feed equals the speed of the revolving conveyor belt.

The bending considered disadvantageous during solidification is prevented by supporting the underside of the casting belt receiving the melt upon a multiplicity of rollers placed side-by-side. The support is reinforced by generating in the region of the casting belt a negative pressure to press the casting belt firmly against the rollers.

In order to maintain these conditions during the critical phase of solidification, the length of the conveyor belt is selected in such a way that the roughed strip is substantially solidified at the end of the conveyor belt before the latter is deflected.

The end of the conveyor belt is followed by a homogenization zone which is utilized for a temperature equalization and possible stress relief.

Rolling of roughed strip into hot strip may be realized either in-line or separately off-line. Before off-line rolling, the roughed strip after production and before cooldown can either be coiled directly in hot state or cut into panels. The strip or panel material is then reheated after possible cooldown and unwound for off-line rolling or reheated as panel and rolled.

Beneficial technical values are attained when the degree of deformation is >70% and a mean grain size of >6 ASTM can be adjusted.

A preferred grade for the ferritic steel includes high Mn contents of up to 30 weight-%, with high Al contents of >2, preferably >5 weight-%, and Cr contents of up to 30 weight-% as well as Si contents of <5 weight-% and C contents of <1.5 weight-%.

A further preferred grade is characterized by the absence of Mn and absence of Si and the presence of comparable C, Cr, and Al contents.

Both mentioned grades may optionally contain one or more precipitation-forming elements of type B, Ta, Zr, Nb, V, Ti, Mo and W collectively at a maximum of 2 weight-%.

BRIEF DESCRIPTION OF THE DRAWING

NONE

DETAILED DESCRIPTION OF PREFERRED EMBODIMENTS

NONE

The invention claimed is:

1. A method for producing a hot strip from a transformation-free ferritic steel, comprising the steps of:

casting a melt in a horizontal strip casting facility under conditions of a calm flow and free of bending to form a roughed strip having a thickness in a range between 6 and 20 mm; and rolling the roughed strip into a hot strip with a degree of deformation of at least 50%, wherein the transformation-free terrific steel has a chemical composition in weight-% of <1.8C; <30Cr; >5Al, remainder iron including unavoidable steel-accompanying elements.

2. The method of claim 1, further comprising feeding the melt into the horizontal strip casting facility at a speed which equals a speed of a revolving conveyor belt of the horizontal strip casting facility.

3. The method of claim 2, further comprising subjecting all surface elements of a strand shell, forming at the start of solidification, of a strip extending across a width of the conveyor belt to approximately same cooldown conditions.

4. The method of claim 2, wherein the melt on the conveyor belt has substantially solidified at an end of the conveyor belt.

5. The method of claim 1, further comprising passing the roughed strip through a homogenizing zone after complete solidification and before starting a further treatment.

6. The method of claim 5, wherein the further treatment involves cutting the roughed strip into panels.

7. The method of claim 6, further comprising heating the panels to a rolling temperature, and subsequently subjecting the panels to a rolling process.

8. The method of claim 5, wherein the further treatment involves a coiling of the roughed strip.

9. The method of claim 8, further comprising unwinding the roughed strip, heating the roughed strip to a rolling temperature, and subsequently subjecting the panels to a rolling process.

10. The method of claim 9, further comprising reheating the roughed strip before being the unwinding step.

11. The method of claim 1, further comprising subjecting the roughed strip in line to the rolling step, and further comprising coiling up the roughed strip.

12. The method of claim 1, wherein the degree of deformation is >70% during hot rolling.

13. The method of claim 2, further comprising applying a negative pressure in an area of the conveyor belt.

14. The method of claim 2, further comprising supporting an underside of the conveyor belt by a plurality of rollers in side-by-side relationship.

15. The method of claim 1, wherein the hot strip has a mean grain size of >6 ASTM.

16. The method of claim 1, wherein the transformation-free ferritic steel has optionally one or more precipitation-forming elements of type B, Ta, Zr, Nb, V, Ti, Mo and W collectively at a maximum of 2 weight-%.

* * * * *